United States Patent [19]

King et al.

[11] Patent Number: 4,759,431

[45] Date of Patent: Jul. 26, 1988

[54] TRAVEL BAG WITH COMBINATION PULL HANDLE AND AUXILIARY BAG STRAP

[75] Inventors: William L. King, Denver; Daniel G. Elles, Kittredge, both of Colo.

[73] Assignee: Samsonite Corporation, Denver, Colo.

[21] Appl. No.: 38,508

[22] Filed: Apr. 15, 1987

[51] Int. Cl.[4] ..... A45G 5/14; A45G 13/30

[52] U.S. Cl. ..... 190/18 A; 190/108; 190/115

[58] Field of Search ..... 190/18 A, 108, 115, 190/39, 101, 102, 15.1; 280/37

[56] References Cited

U.S. PATENT DOCUMENTS

| | | | |
|---|---|---|---|
| 2,581,417 | 1/1952 | Jones | 190/18 A |
| 2,707,035 | 4/1955 | Lashley | 190/108 X |
| 3,606,372 | 9/1971 | Browning | 190/115 X |
| 3,995,802 | 12/1976 | Johnston | 190/115 X |
| 4,223,819 | 9/1980 | Wright | 190/115 X |
| 4,621,404 | 11/1986 | Browning | 190/102 X |

FOREIGN PATENT DOCUMENTS

| | | | |
|---|---|---|---|
| 0021918 | 1/1981 | European Pat. Off. . | |
| 187183 | 7/1986 | European Pat. Off. | 190/15.1 |
| 2056657 | 5/1972 | Fed. Rep. of Germany . | |
| 2353629 | 3/1974 | Fed. Rep. of Germany . | |
| 2356011 | 6/1974 | Fed. Rep. of Germany . | |
| 2359229 | 6/1975 | Fed. Rep. of Germany . | |
| 961977 | 11/1949 | France . | |
| 59346 | 1/1954 | France . | |
| 1563534 | 4/1969 | France . | |
| 2441358 | 6/1980 | France | 190/18 A |

*Primary Examiner*—William Price

*Attorney, Agent, or Firm*—Gary M. Polumbus

[57] ABSTRACT

Luggage of the type adapted to maintain articles of clothing, business materials and the like is disclosed having roller means along a lower edge thereof and a modular handle unit adapted to be extended away from the luggage to provide a pull handle therefor and further including an elongated strap adapted to be extended around an auxiliary piece of luggage to piggyback the auxiliary piece of luggage on the main piece of luggage.

30 Claims, 7 Drawing Sheets

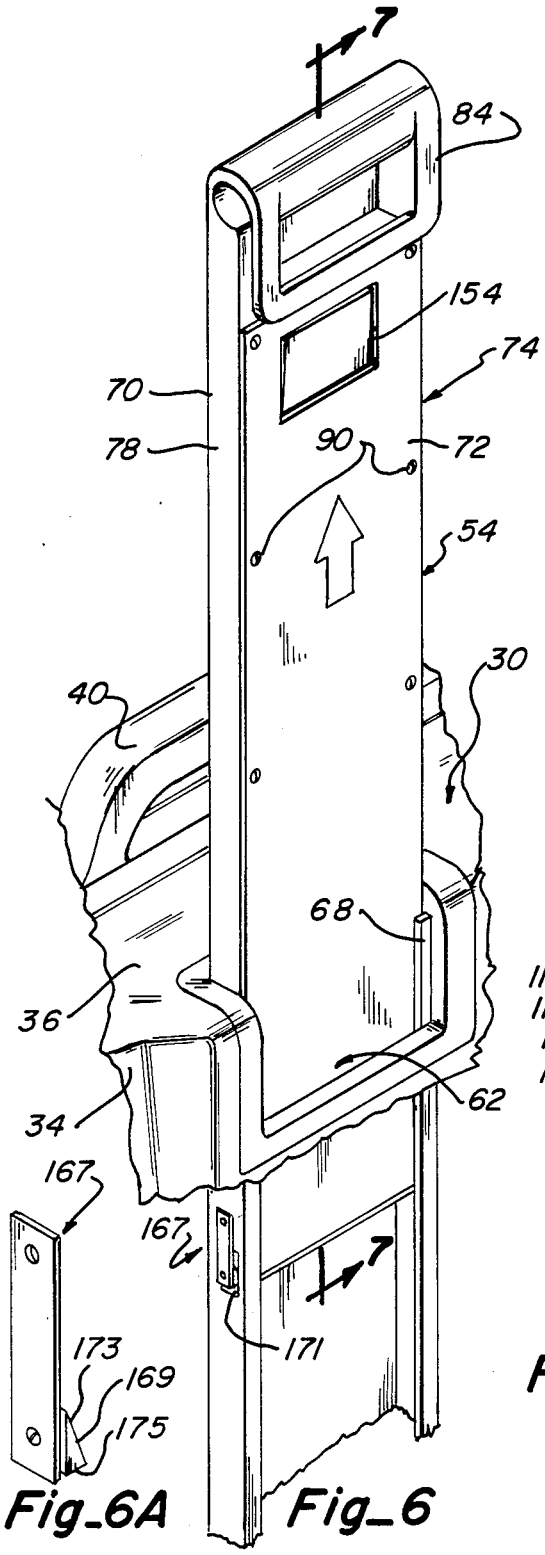
Fig_6A
Fig_6
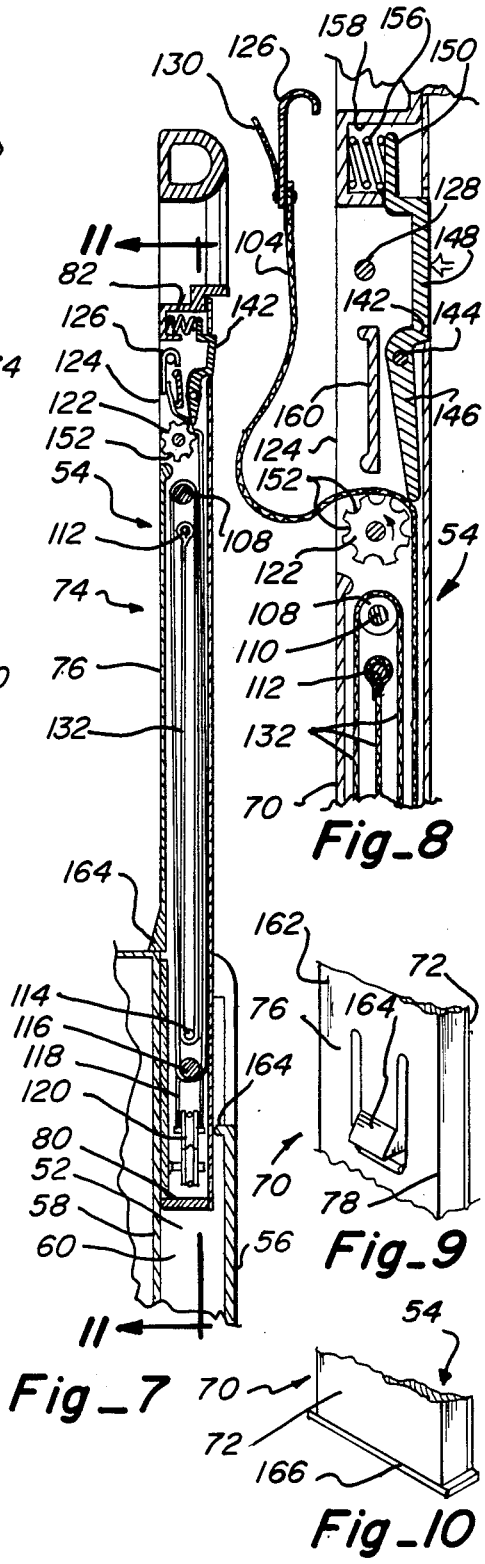
Fig_8
Fig_9
Fig_7
Fig_10

252
246

245
276
258
282
250
246

252
276
245
280
258
282
262
260
278
246

271
252
282
245
282
258
276
262
260
280
270
272
254
266
250
269
268
248
264

245
252
258
256
270
248
250
246

TRAVEL BAG WITH COMBINATION PULL HANDLE AND AUXILIARY BAG STRAP

BACKGROUND OF THE INVENTION

1. Field of the Invention

The present invention relates generally to articles of luggage and more particularly to an article of luggage of the type having wheels thereon and a handle for rolling the luggage along a supporting surface as well as a strap for securing auxiliary articles of luggage to the main article.

2. Description of the Prior Art

Luggage of the type adapted to maintain articles of clothing, business materials and the like has traditionally been transported by lifting the article of luggage with a handle fixedly secured thereto. In more recent years, however, particularly with larger pieces of luggage or those adapted to carry heavy articles, wheels have been permanently mounted in the luggage and an auxiliary handle provided to push or pull the piece of luggage on its wheels across a supporting surface. Numerous arrangements of handles have been utilized and in many cases the handles are awkwardly mounted on the exterior of the luggage in a position where it detrimentally affects the esthetics of the luggage and is also in a position wherein it is easily damaged. Some such auxiliary handles have been partially concealed within a portion of the body of the luggage in an attempt to overcome the shortcomings in prior art systems.

Such wheeled embodiments of luggage have met with great success and due to the fact that greater weights can be transported in this manner, systems have been developed for piggybacking articles of luggage so that several pieces of auxiliary luggage can be transported on a single piece of wheeled luggage. Systems for piggybacking luggage typically consist of fixed length straps or expandable straps that can be wrapped around the auxiliary pieces of luggage as well as a portion of the wheeled piece of luggage to releasably secure the pieces together. These straps, however, are typically not connected to the wheeled piece of luggage, or if they are connected to the wheeled piece of luggage, they are connected in a manner so as to distract from the aesthetics of the luggage or they are attached in a location where they are easily snagged or damaged by other articles, thereby creating an inconvenience to the user of the luggage and, accordingly, such systems have not met with great success.

It is accordingly a primary object of the present invention to provide a piece of wheeled luggage having handle means for rolling the luggage across a supporting surface and strap means for piggybacking auxiliary pieces of luggage which overcomes the shortcomings of the prior art.

It is more specifically an object of the present invention to provide a system for substantially concealing a tow handle and an auxiliary strap in a piece of luggage such that neither the handle nor the strap detract from the aesthetics of the bag and are prevented from being accidentally damaged.

It is a further object of the present invention to provide an auxiliary handle and strap for attaching auxiliary pieces of luggage wherein deployment of the auxiliary handle automatically exposes the strap for use in connecting auxiliary pieces of luggage.

It is still a further object of the present invention to provide an article of wheeled luggage wherein the handle for carrying the luggage can also be used in a convenient manner to roll the luggage across a supporting surface and wherein a strap is operatively associated with the handle for connecting auxiliary pieces of luggage in a piggybacked manner.

SUMMARY OF THE INVENTION

The present invention is directed primarily to a piece of wheeled luggage which has a pull handle for facilitating rolling movement of the luggage and a built-in strap for conveniently attaching auxiliary pieces of luggage to the wheeled piece of luggage.

In several disclosed embodiments of the invention a modular handle unit is adapted to be incorporated into the wheeled piece of luggage so that a grip incorporated into the handle unit can be extended to further facilitate rolling movement of the luggage across a supporting surface while providing a system for controlling the strap which is adapted to secure auxiliary pieces of luggage to the wheeled piece of luggage.

The modular handle unit can be incorporated into one of the outer walls of the luggage or into a central divider between opposing component parts of a piece of luggage and in either event the unit is substantially concealed in a manner so as not to detract from the aesthetics of the luggage. In one preferred embodiment of the invention, the grip provided on the handle unit can be used in one condition to carry the piece of luggage or in another condition extended away from the main body of the piece of luggage to facilitate rolling movement of the luggage across a supporting surface. The strap is incorporated into the handle unit in several embodiments and where so incorporated, is concealed when the handle unit is retracted so as to prevent the strap from detrimentally affecting the aesthetics of the bag and also to protect the strap from being damaged or engaged by other items.

In the embodiments where the strap is incorporated into the handle unit, the handle unit is designed to maintain the strap in a ready, deployable position upon extension of the handle unit so that the strap is automatically placed in a position for use upon extension of the handle unit. In several embodiments, the strap, upon being extended away from the handle unit, is automatically biased into its retracted position so that upon completion of its use, it is easily returned to its stored position within the handle unit. In another embodiment, the strap is merely wrapped around a mounting plate in the handle unit so that it can be unwrapped in an easy manner for use in securing auxiliary luggage to the main piece of luggage and upon completion of use, can be easily returned to the mounting plate for storage within the handle unit. In still another embodiment, the strap is conveniently positioned in a groove provided on the outer surface of the luggage so that it is readily deployable but protected so that it will not snag on other articles and is not unattractive from an aesthetic viewpoint.

As will be appreciated from the detailed description of the invention which follows, the handle unit utilized in the luggage of the present invention can be used in connection with hard or soft shelled luggage.

Other aspects, features and details of the present invention can be more completely understood by reference to the following detailed description of a preferred embodiment, taken in conjunction with the drawings, and from the appended claims.

BRIEF DESCRIPTION OF THE DRAWINGS

FIG. 6 is an enlarged fragmentary perspective view illustrating the handle unit of the article of luggage illustrated in FIG. 1 in an extended position.

FIG. 6A is a perspective view of the spring release element utilized to selectively control release of the handle unit.

FIG. 7 is a fragmentary section taken along line 7—7 of FIG. 6.

FIG. 8 is an enlarged fragmentary vertical section similar to FIG. 7 with the strap being partially extended.

FIG. 9 is a fragmentary perspective view of the handle unit utilized on the article of luggage shown in FIG. 1 illustrating the latch for retaining the handle unit in its retracted position.

FIG. 10 is a fragmentary perspective view similar to FIG. 9 illustrating the system for retaining the handle unit on the article of luggage of FIG. 1 when the handle unit is in its extended position.

DESCRIPTION OF THE PREFERRED EMBODIMENT

The article of luggage of the present invention utilizes a handle unit that includes a modular slide element and a cooperating pocket that can be incorporated into different types of luggage including travel bags, carrying cases, valises and the like. As will be appreciated from the detailed description that follows, the handle unit can be used in hard shell or soft shell luggage but is principally adapted for use on luggage of the type having wheels or the like on which the luggage can be rolled across a supporting surface.

Figure 1:
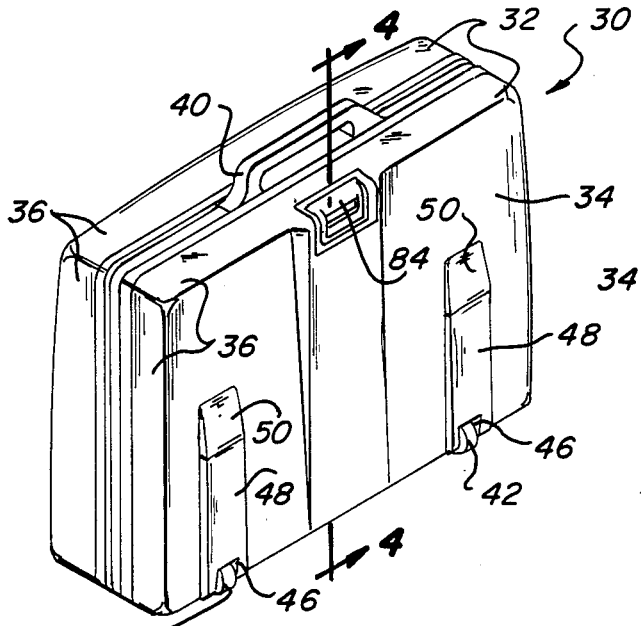
FIG. 1 is a perspective view of an article of luggage in accordance with a first embodiment of the present invention.
Figure 2:
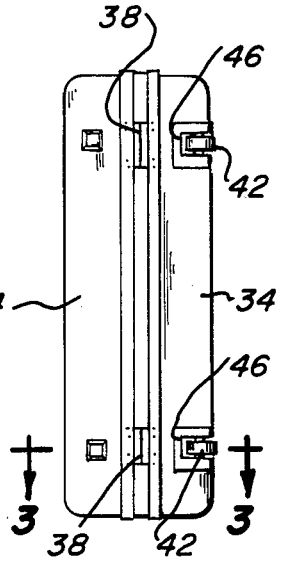
FIG. 2 is a bottom plan view of the article of luggage illustrated in FIG. 1.
Figure 3:
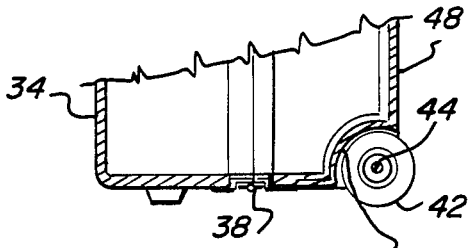
FIG. 3 is an enlarged fragmentary section taken along line 3—3 of FIG. 2.
Figure 4:
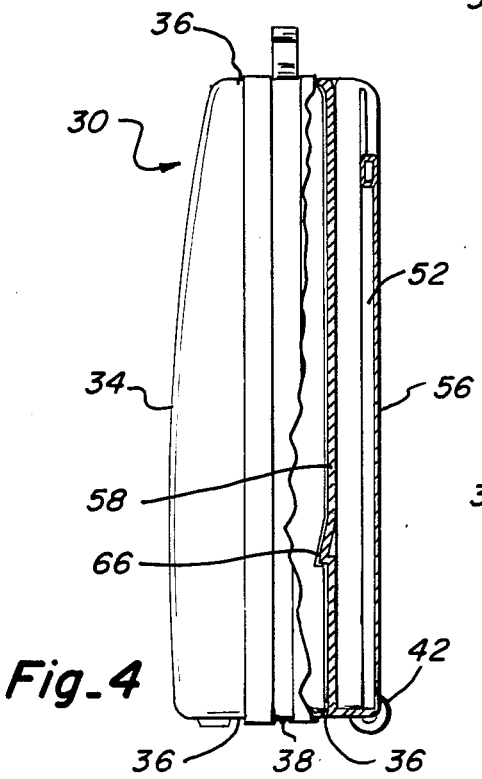
FIG. 4 is an enlarged framentary section taken along line 4—4 of FIG. 1.
Figure 5:
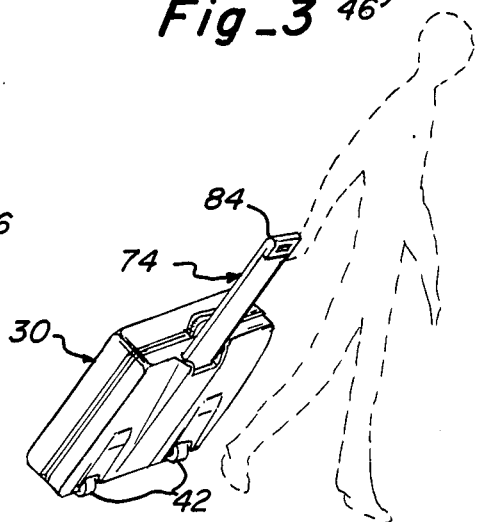
FIG. 5 is a perspective view of the article of luggage illustrated in FIG. 1 being transported by an individual illustrated in dashed lines.

There are several embodiments of the present invention which will be described hereinafter but reference is made first to FIGS. 1 through 13 illustrating a first embodiment. In FIG. 1, a piece of luggage 30 in the form of a hard shelled suitcase, is disclosed and is of a generally conventional type having a main body formed from two similar component parts 32, with each component part including a large side face panel 34 and four perpendicular edge panels 36. The component parts 32 are pivotally attached together by hinge means 38 extending along the lower edge panels 36 of the suitcase. A fixed handle 40 is attached to one component part 32 at a centrally located position on a top edge panel 36 so that the suitcase can be carried in a conventional manner. In the side face panel of one component part, as best seen in FIGS. 1, 2 and 4, a pair of roller wheels 42 are rotatably mounted on support shafts 44 mounted in pockets 46 formed in the side face panel of the suitcase. In vertical alignment with the pockets, a pair of raised slide plates 48 are also formed in the side face panel having tapered upper ends 50 to protect the side face panel, particularly when the suitcase is being rolled along a supporting surface on the roller wheels.

In accordance with the present invention, and as best illustrated in FIGS. 4, 6 and 7, an elongated generally rectangularly shaped pocket 52 is formed in the side face panel 34 having the roller wheels 42 mounted thereon and is adapted to receive a slide element 54 forming an extensible handle or lever by which the suitcase can be guided as it is rolled along a supporting surface. As best seen in FIG. 4, the pocket 52 has a flat exterior wall 56 and a flat interior wall 58 along with opposing side walls 60 connecting the exterior and interior walls and the pocket opens at 62 through the top edge panel 36 of the component part 32 as best seen in FIG. 6. The interior wall 58 has a notch 66 formed therein of generally triangular shaped cross section which serves to releasably retain the slide element in a retracted position, also in a manner to be described later. With particular reference to FIG. 6, a pair of elongated tabs 68 (only one of which is seen) are mounted on the component part 32 and extend into the opening 62. The tabs 68 guide sliding movement of the slide element 54 from a stored position within the pocket to an extended position as shown in FIG. 6. The tabs define a slot between the interior wall 58 and the tabs so that the slide element 54 is held in close sliding relationship with the interior wall.

The slide element is of modular box type configuration having a generally tray shaped body 70 with a cover plate 72 adapted to overlie the body to form a box 74 which defines a substantially concealed space therewithin. The body 70 has a bottom plate 76 with integral upstanding side edges 78, a bottom edge 80, a top edge 82, and an inverted loop-shaped handle or grip 84 formed along the top edge 82 which can be easily gripped by a user of the suitcase.

Figure 11:
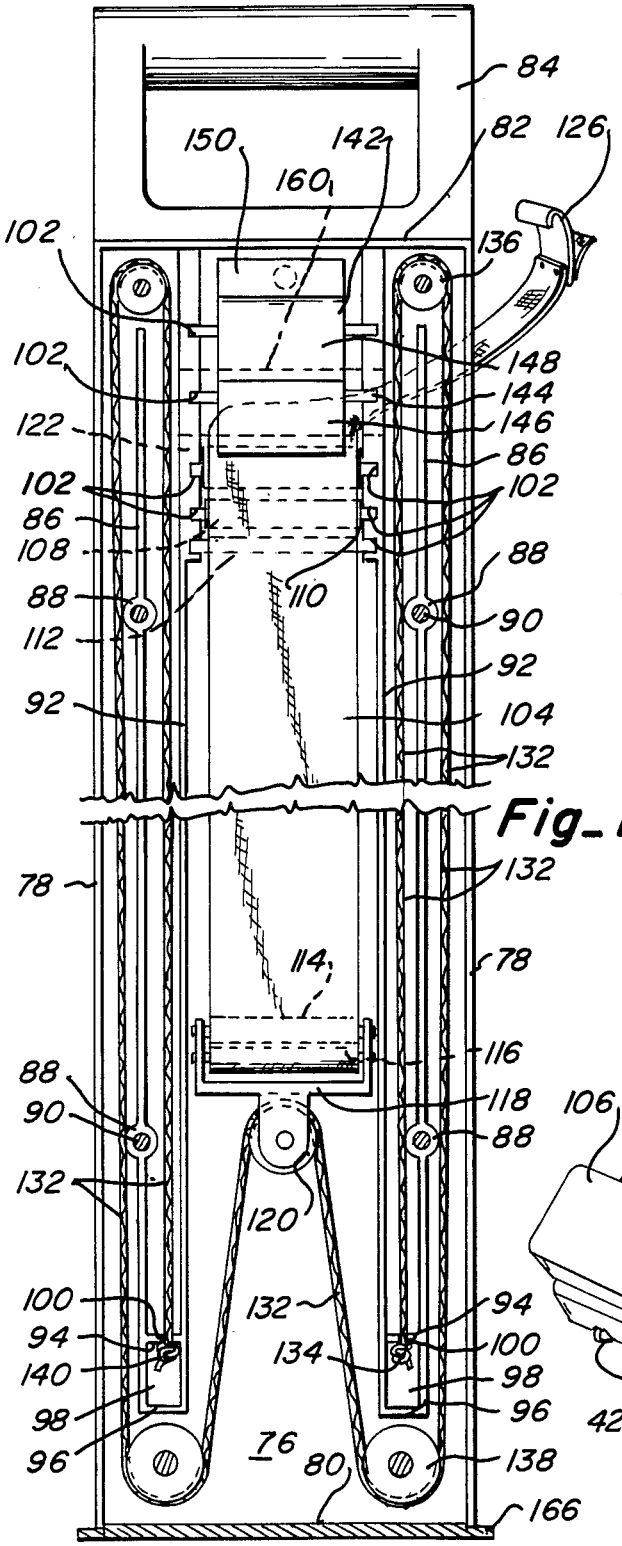
FIG. 11 is an enlarged section taken along line 11—11 of FIG. 7.

As best seen in FIG. 11, the bottom plate 76 of the body 70 has a plurality of integrally formed and upstanding dividers defining a plurality of chambers and areas within the body so that the working parts of the handle unit will function in an efficient and failsafe manner. The dividers are symmetrically disposed on the bottom plate and include outer divider ribs 86 extending substantially the entire length of the slide element 54 but leaving a gap at the top and bottom. Spaced bosses 88 are provided in the divider ribs 86 so that fastener means 90 can be passed through the cover plate 72 and into the bosses to secure the cover plate to the body 70. Disposed immediately inwardly of the outer divider rib 86 is an inner divider rib 92 extending parallel to the outer rib and being connected at its upper end to the top edge 82 and extending downwardly so as to terminate an equal distance from the bottom edge 80 as the outer rib. The inner and outer divider ribs are connected on their lower end and at a location spaced slightly upwardly from their lower ends by upper and lower transverse ribs 94 and 96 respectively so as to define a pocket 98 at the lower end of the inner and outer ribs. The upper transverse rib 94 has an opening 100 therethrough for a purpose to be described hereinafter. The inner rib 92 which is relatively thick near its upper end has a plurality of spaced cylindrical recesses 102 adapted to rotatably receive transverse shafts which form operating component parts of the handle unit as will be described hereinafter.

Figure 12:
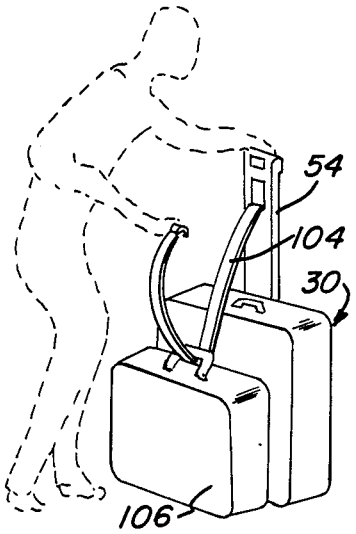
FIG. 12 is a perspective view of an individual shown in dashed lines utilizing the strap of the handle unit to secure an auxiliary piece of luggage.
Figure 13:
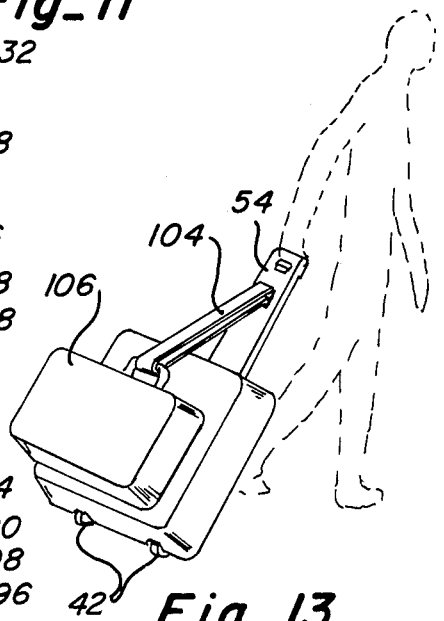
FIG. 13 is a perspective view of the article of luggage shown in FIG. 1 with an individual shown in dashed lines transporting the main piece of luggage and a piggybacked piece of auxiliary luggage.

The slide element 54 includes an elongated strap 104 preferably of an inelastic webbing material which can be utilized to attach an auxiliary piece of luggage 106 (FIGS. 12 and 13) to the suitcase 30 by passing the strap around a portion of the auxiliary piece of luggage and reattaching the strap to the slide element 54. This is illustrated in FIGS. 12 and 13 with the strap 104 having been passed through the handle of a conventional auxiliary suitcase and returned to the box 74 so that the auxiliary suitcase is disposed upon the main suitcase in a piggyback fashion. The strap 104 is mounted in the handle unit so as to be extensible away therefrom as shown in FIGS. 12 and 13 but can be retracted into a stored position within the box 74 where it is entirely confined until ready for use.

The strap forms a part of a block and tackle type pulley system so that as it is extended from its stored position to its extended position it is yieldingly biased into its stored position. Accordingly, when the strap is no longer in use it will self-retract into the handle unit. The block and tackle type system as is best seen in FIGS. 7, 8 and 11 includes a fixed upper roller 108 mounted on a transverse shaft 110, a fixed upper pin 112 mounted immediately below the fixed roller 108 with the ends of the pin and the roller shaft being seated in aligned cylindrical recesses 102 in the inner rib 92. A movable pair of roller members, defined as upper and lower movable rollers 114 and 116 respectively, are mounted on rotatable shafts journaled in a yoke element 118 and extend transversely of the slide element 54. The yoke element carrys a pulley 120 on its underside and is disposed for vertical reciprocal movement in the space defined between the two inner ribs 92.

The elongated strap 104 itself has an inner end anchored to the upper fixed pin 112 so that the strap extends downwardly therefrom as best seen in FIG. 7 and passes around the upper movable roller 114 on the yoke element 118, then extends upwardly around the fixed upper roller 108 and subsequently downwardly around the movable lower roller 116 on the yoke element and thence upwardly again until it crosses over an elongated star wheel 122 also rotatably mounted on a transverse shaft whose ends are journaled in aligned recesses 102 in the inner rib 92. The free end of the strap 104 extends outwardly through an opening 124 provided in the bottom plate 76 of the body 70 and carries a hook-shaped anchor 126 which can be releasably set on a transverse anchor shaft 128 mounted in the box 74 above the star wheel 122 in spaced location therefrom. The transverse anchor shaft 128 has its ends set in aligned cylindrical recesses 102 in the inner rib 92. A leather tab 130 is fixed to the hook-shaped anchor 126 to facilitate manipulation of the strap 104.

An elastic cord 132 is utilized to bias the strap into its stored or retracted position of FIG. 7 with the elastic cord being anchored at one end 134 by knotting the end after the strap has been inserted through the opening 100 in the upper transverse rib 94 so that the knotted end of the cord is retained in the pocket 98. The cord 132 extends upwardly from this anchored end and passes around a pulley 136 mounted adjacent the upper end of the body 70 and subsequently is passed downwardly so as to pass around a pulley 138 anchored adjacent the lower end of the body 70 and from there the cord passes around the pulley 120 on the yoke element 118 and thence through a similar path on the opposite side of the body 70 so that the opposite end 140 of the cord is anchored in the pocket 98 defined between the inner and outer ribs 92 and 86 respectively on the opposite side of the body 70. In this manner, it will be appreciated that upward movement of the yoke element, as will be experienced as the strap 104 is pulled out of the box 74 to its extended position, will be yieldingly resisted by the elastic cord 132 so that upon release of the strap, the elastic cord will pull the yoke element downwardly, thus retracting the strap to its stored position.

As best seen in FIGS. 7, 8 and 11, a lock lever 142 is mounted on a pivot shaft 144 whose ends are also journaled in aligned cylindrical recesses 102 in the inner ribs 92, and the lock lever serves to cooperate with the star wheel 122 in selectively retaining the strap 104 in any one of an infinite number of extended positions. The lock lever is made from a relatively rigid piece of material and has a lower leg portion 146, a contact plate 148 and an abutment tab 150. The lower leg portion 146 is adapted to protrude generally into any one of the longitudinal grooves 152 provided in the surface of the star wheel 122 to lock the strap 104 in a selected position but can be moved out of the groove 152 by depressing the contact plate 148 which is immediately above the pivot shaft 144 so as to pivot the lower leg in an opposite direction. The contact plate is exposed through a rectangular opening 154 provided in the cover plate 72 of the slide element 54 so that it can be easily accessed when operating the strap. The abutment tab 150 is disposed immediately above the contact plate 148 in confronting relationship with a coil spring 156 seated in a pocket 158 provided in the body 70 with the coil spring biasing the lock lever into the locking position of FIG. 7 with the lower leg extending into a groove in the star wheel. The bias of the coil spring, however, is easily overcome by depressing the contact plate 148 as shown in FIG. 8 thereby compressing the coil spring and allowing the lower leg 146 to be moved out of a groove 152 on the star wheel. In this position the strap is free to move in the space between the lower leg 146 and the star wheel 122 when the strap is being extended or retracted. A vertical rib 160 is also formed on the body 70 immediately above the star wheel 122 so as to retain the strap in close relationship to the star wheel so that the desired cooperation between the lock lever and the star wheel is dependably retained.

In operation of the strap 104, it is removed from the anchor shaft 128 by lifting up on the leather tab 130 and depressing the contact plate 148 on the lock lever to release the strap from the star wheel 122 so that it is free to move outwardly to its extended position. As the strap is pulled outwardly, it is taut across the grooves 152 on the star wheel so that the lock lever will not re-engage and therefore a user does not have to continually depress the lock lever as the strap is being pulled out of the box 74. However, once outward movement of the strap is terminated, the lock lever, under the bias of the coil spring 156, automatically pinches the strap between itself and the star wheel thereby preventing further movement of the strap without again depressing the lock lever. When it is desired to retract the strap, the contact plate 148 on the lock lever 142 is depressed and the strap will automatically retract due to the elastic cord 132 which pulls the yoke element 118 downwardly thus wrapping the strap around the various roller elements in the block and tackle type system.

Referring to FIGS. 7 and 9, it will be seen that a flexible tab 162 is formed in the bottom plate 76 of the body 70 at a location spaced upwardly from the lower end of the body with the tab 162 functioning as a releasable latch to retain the slide element 54 in either of its extended or retracted positions. As will be appreciated, the tab 162 has an enlarged bevelled head 164 adapted to be seated in the notch 66 formed in the interior wall 58 to releasably retain the slide element in its retracted position. An outward pulling force applied to the handle or grip 84, however, will allow the bevelled head 164 to move out of the notch 66 so that the slide element can be extended. When fully extended to the position of FIG. 7, the bevelled head will snap out over the top edge panel 36 to prevent the slide element from returning to its retracted position. Manual depression of the tab, however, will allow the slide element to be slid back to its retracted position of FIG. 4 and be retained therein when the bevelled head 164 snaps back into the notch 66.

The lower end of the slide element 54 has a stop block 166 secured thereto as illustrated in FIG. 10. The stop block 166 is adapted to cooperate with a spring release 167 to prevent the slide element from being pulled out of the pocket 52. As can be seen in FIG. 10, the stop block 166 is a rectangular plate that is slightly larger in dimension than the cross sectional area of the slide element so as to protrude slightly from all sides of the slide element. The spring release 167 is merely a leaf spring having a bevelled head 169 secured to its lower end and affixed to the outside surface of one of the side walls 60 of the pocket 52 so that the bevelled block protrudes through an opening 171 in the side wall 60 with a bevelled surface 173 on the block facing upwardly and a lower flat surface 175 of the block extending parallel to the stop block 166. In this manner, when the slide element 54 reaches its extended position of FIG. 6, the overhang of the stop block 166 on one end thereof will engage the flat surface 175 of the bevelled block 169 to prevent further outward sliding movement of the slide element. When the stop block 166 is engaged with the lip 64, the flexible tab 162 overlies the top edge panel 36 so that the slide element is positively but releasably positioned in its extended position.

The spring release 167 also functions to permit removal of the slide element 54 if desired to repair the mechanism carried inside thereof. To remove the slide element, a long thin element such as a knife blade can be inserted into the narrow space between one side wall 60 of the pocket 52 on which the spring release is mounted until the thin element engages the bevelled surface 173 of the block 169 thus camming the block laterally causing it to move out of the path of movement of the stop block 166 so that the slide element can be freely removed from the pocket 52 for repairs.

It will be appreciated from the aforenoted description of the first embodiment of the present invention that a handle unit has been disclosed which can be used to maneuver a piece of luggage having roller wheels thereon and also includes a normally concealed strap for attaching an auxiliary piece of luggage to the main piece of luggage. The strap is automatically exposed for use upon extension of the handle unit. It will also be appreciated that the operating mechanism for the strap is confined within the handle unit so that it is not easily damagable by contact with outside elements. The mechanism is also simple in construction so that the system is dependable in operation and is very easily operable and manageable.

In a second embodiment of the present invention illustrated in FIGS. 14 through 21, the handle unit 168 is disclosed as being mounted in one face panel of a suitcase 170 or the like with only a portion of the suitcase being illustrated. The handle unit again includes a pocket 172 and a slide element 174 slidably disposed in the pocket.

The slide element 174 in the second embodiment includes a body portion 176 having a bottom plate 178, four peripheral upstanding side plates 180 and a pair of inturned flanges 182 forming a portion of a top plate thereby leaving a slot 184 in the top of the body 176 between the two flanges 182. A handle or grip portion 186 is formed at the top of the handle unit by an inverted loop so that the slide element can be easily gripped by a user. A slide cover plate 188 is slideably received in the slot 184 between the two flanges and is movable by a lock handle 190, the operation of which will be described hereinafter.

A strap 192 for use in securing an auxiliary piece of luggage to the main piece of luggage 170 is confined within the body 176 by a block and tackle type system wherein a pair of fixed roller members 196 and 198 are journaled on rotation shafts in an anchor block 200 at the bottom of the main body and a pair of movable rollers 202 and 204 are mounted on rotation shafts journaled in a slide block member 206 disposed in the space between the cover plate 188 and the bottom plate 178 of the body 176. One end of the strap is anchored to the roller 196 on the fixed block 200 at the bottom of the body 176 and extends upwardly around the roller 204 on the slide block and then downwardly around the roller 196 on the fixed block before again turning upwardly and passing around the roller 202 on the slide block from which the strap again turns downwardly and passes around the roller 198 on the fixed block before extending upwardly along the inside face of the bottom plate 178 before extending outwardly through an opening 208 provided in the bottom plate of the body 176 near the upper end thereof.

The lock handle 190 extends transversely of the slide cover plate 188 at the upper end thereof and is eccentrically mounted on a transverse shaft 210 whose ends are journaled in a handle mounting block 212 attached to the inside surface of the slide cover plate. Opposite ends of the block 212 have passages 214 formed therein for a purpose to be described hereinafter.

A pair of abutment blocks 216 are also secured to the inside surface of the slide cover plate 188 at a location spaced downwardly from the handle mounting block 212 so that the slide block 206 which is not attached to either the cover plate 188 or the body 176 is confined between the handle mounting block 212 and the abutment blocks 216. The slide block on one side thereof has a groove 218 formed therein in alignment with the associated passage 214 in the handle mounting block and on the opposite side has a hole 220 extending therethrough terminating in a recessed area 222 on the underside of the slide block.

A flexible but nonextensible guide cord 224 extends along one side of the slide element 174 between the bottom plate 178 and one of the overlying flanges 182 and is anchored at the top end to a transverse plate 226 affixed to the body 176 and at the lower end to the fixed block 200 on which the fixed rollers 196 and 198 are rotatably mounted. The guide cord 224 passes through the grooves formed in the handle mounting block 212, the slide block 206, and the abutment blocks 216 so that each block is guided in movement along the length of the body 176 as will become evident with the operation of the device which will be described later.

On the opposite side of the body 176, a resilient or elastic cord 228 is anchored at its upper end to the transverse plate 226 and extends downwardly through the passage 214 provided on the associated side of the lock handle mounting block 212 and passes through the hole 220 on the slide block 206 and is anchored in the recessed area 222 therebeneath by knotting the cord. In this manner, one side of the slide block 206 is biased upwardly by the resilient cord 228 while the opposite side of the slide block is not.

Figure 14:
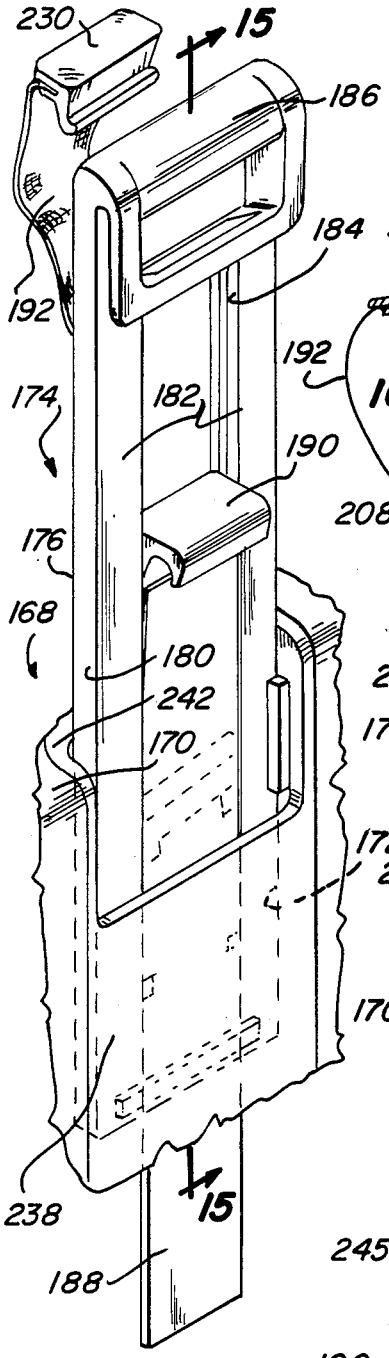
FIG. 14 is a fragmentary perspective view of a second embodiment of the present invention with its handle unit shown in an extended position.
Figure 17:
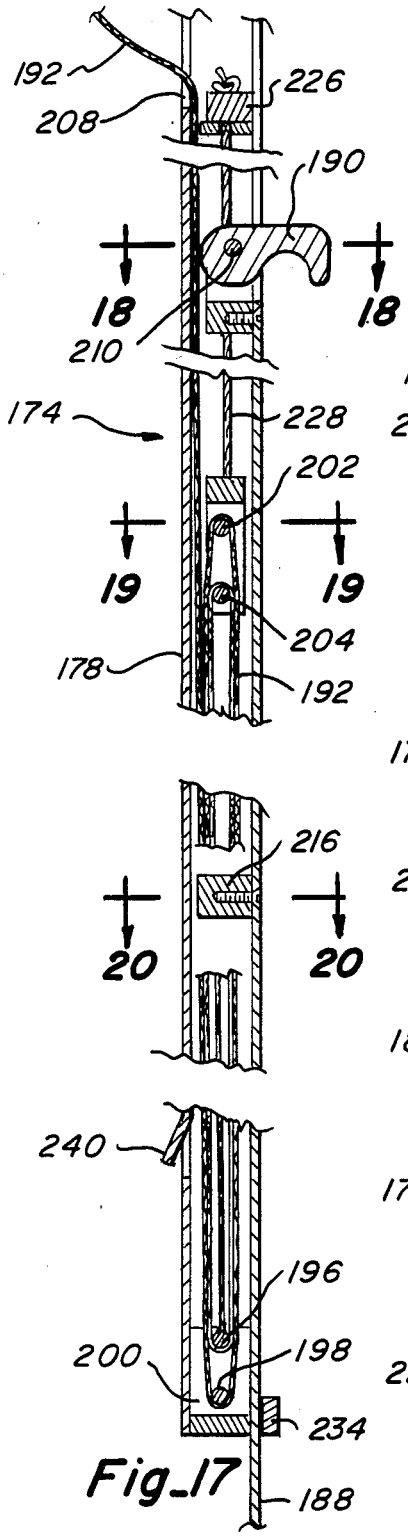
FIG. 17 is a section taken along line 17—17 of FIG. 16.
Figure 18:
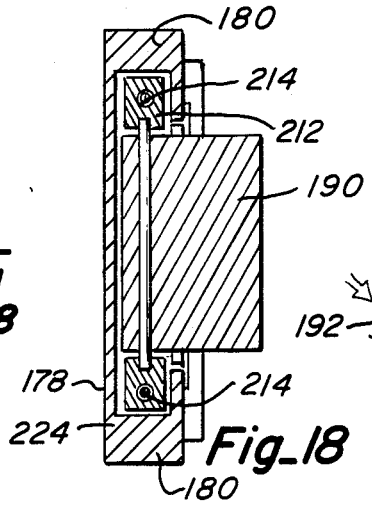
FIG. 18 is a section taken along line 18—18 of FIG. 17.
Figure 19:
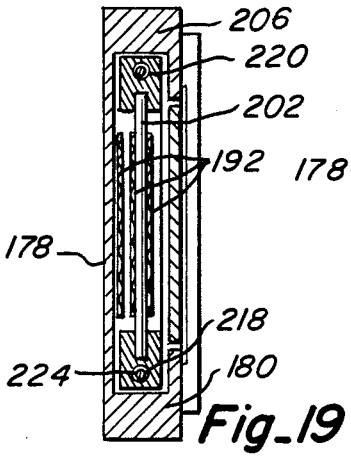
FIG. 19 is a section taken along line 19—19 of FIG. 17.
Figure 20:
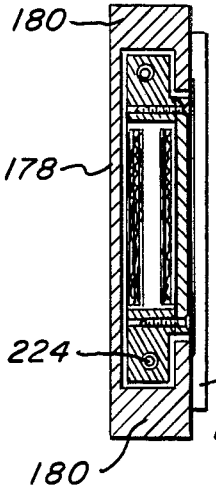
FIG. 20 is a section taken along line 20—20 of FIG. 17.

The strap 192 has on its free end, a gripping element 230 having a generally hook-shaped edge adapted to cooperate with a lip 232 provided in the lower portion of the handle or grip 186 to anchor the end of the strap in the handle when the strap is in a retracted or stored position. To extend the strap, the gripping element 230 is merely removed from the lip 232 and the strap pulled outwardly causing the slide block 206 to move downwardly toward the fixed lower rollers 196 and 198. Downward movement of the slide block causes the slide block to engage the abutment blocks 216 so that the slide cover plate 188 is moved downwardly with the slide block as the strap is extended. This is best illustrated in FIGS. 14 and 17. After the strap has been extended a desired amount to attach an auxiliary piece of luggage, further outward movement of the strap is terminated and the resilient cord 228 pulls upwardly on one side of the slide block causing the slide block to become angularly oriented and wedged between the side walls of the body 176 so that the strap will not retract.

Figure 15:
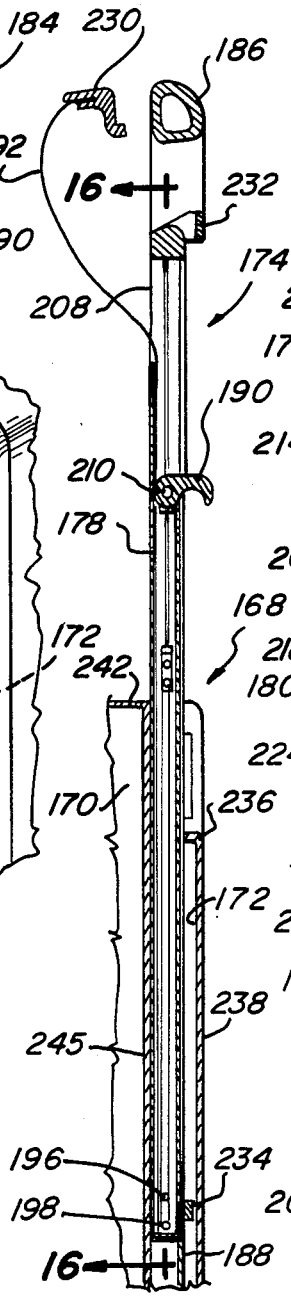
FIG. 15 is a section taken along line 15—15 of FIG. 14.
Figure 16:
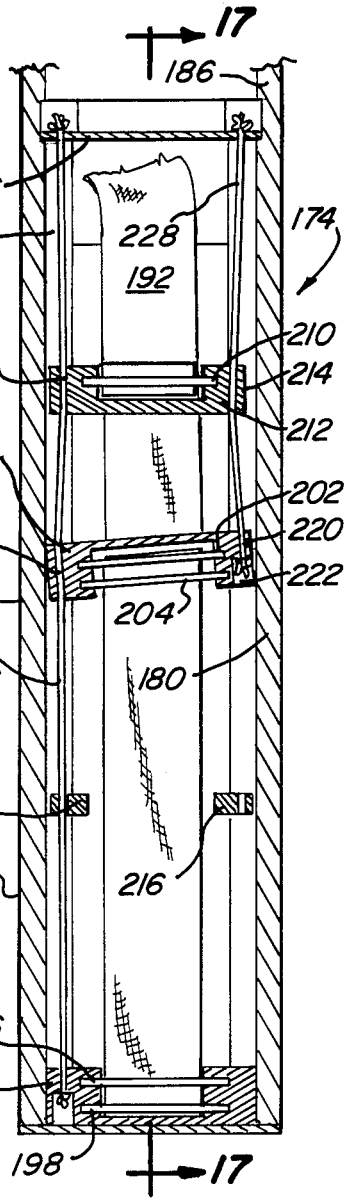
FIG. 16 is a section taken along line 16—16 of FIG. 15.

Further outward movement of the strap 192 can be prevented by rotating the eccentric lock handle 190 at the upper end of the cover plate 188 into its locking position shown in FIGS. 14, 15 and 17 which pinches the strap between the lock handle and the bottom plate 178 of the body 176 thereby preventing further outward movement of the strap. It will, therefore, be appreciated that when the strap is extended, it will not move inwardly due to the wedging of the slide block 206 between the side walls of the body 176 and will not move outwardly due to the fact that it is pinched between the lock handle 190 and the bottom plate 178 so that the strap is retainable in any desired extended position. When extending the strap to a desired position, the lock handle 190 is rotated into the position shown in FIG. 21 wherein there is space between the handle and the bottom plate 178 of the body 176 to allow the strap to slide freely. The same is true when the strap is retracted from an extended position to its stored position.

Figure 21:
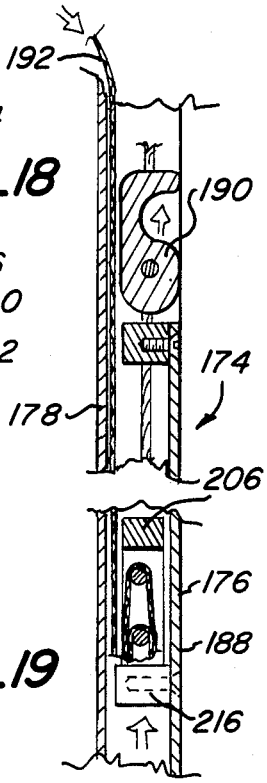
FIG. 21 is a fragmentary vertical section similar to FIG. 17 showing a locking device securing the strap means in an extended position.

When retracting the strap from an extended position to the stored position, the lock handle 190 is moved into the position of FIG. 21 and pulled upwardly by the fingers of the user so that the cover plate 188 is also moved upwardly causing the abutment blocks 216 to engage the slide block 206 thereby straightening the slide block and releasing it from its wedged condition so that the slide block can be moved upwardly causing the strap to be retracted into its stored position.

To prevent the handle unit from being pulled completely out of the suitcase, a stop block 234 is mounted on the bottom plate 178 of the body and abuts a lip 236 formed at the top of an exterior panel 238 of the pocket as seen in FIG. 15. As seen in FIG. 17, a flexible tab 240 is formed in the bottom plate of the body 176 so as to extend outwardly therefrom in a downward direction and forms a cam surface that upon movement of the handle unit into its extended position will cause the tab 240 to flex inwardly until the tab passes the lip 236 and overlies the top edge panel 242 of the suitcase thereby preventing the handle from sliding inwardly again into its retracted position. Of course, to allow the handle to be retracted, it is merely necessary to depress the tab 240 and push the handle unit downwardly. A depression 244 is formed in the interior panel 245 of the pocket on the suitcase to receive the tab 240 when the handle is entirely retracted into the suitcase whereby the handle will not easily pull out of the suitcase but upon moderate pressure being applied thereto by a user, the bias on the tab will be overcome allowing the handle to be pulled out to its extended position.

A third embodiment of the present invention is shown in FIGS. 22 through 26. In this embodiment the handle unit 245 is also disclosed as being mounted in a rigid cased suitcase 246 but is disposed in a divider 248 separating the two component parts 250 of the suitcase along a plane of confrontation. It will be appreciated that the handle unit 245 of this embodiment could also be mounted in a soft covered case in a similar manner. The handle unit in this embodiment includes a grip 252 which serves a dual purpose as being both the carrying handle for the suitcase and also the pull handle for rolling the suitcase along roller members provided along the lower edge of the suitcase in a conventional manner.

Figures 22, 23, 24, 25, 26:
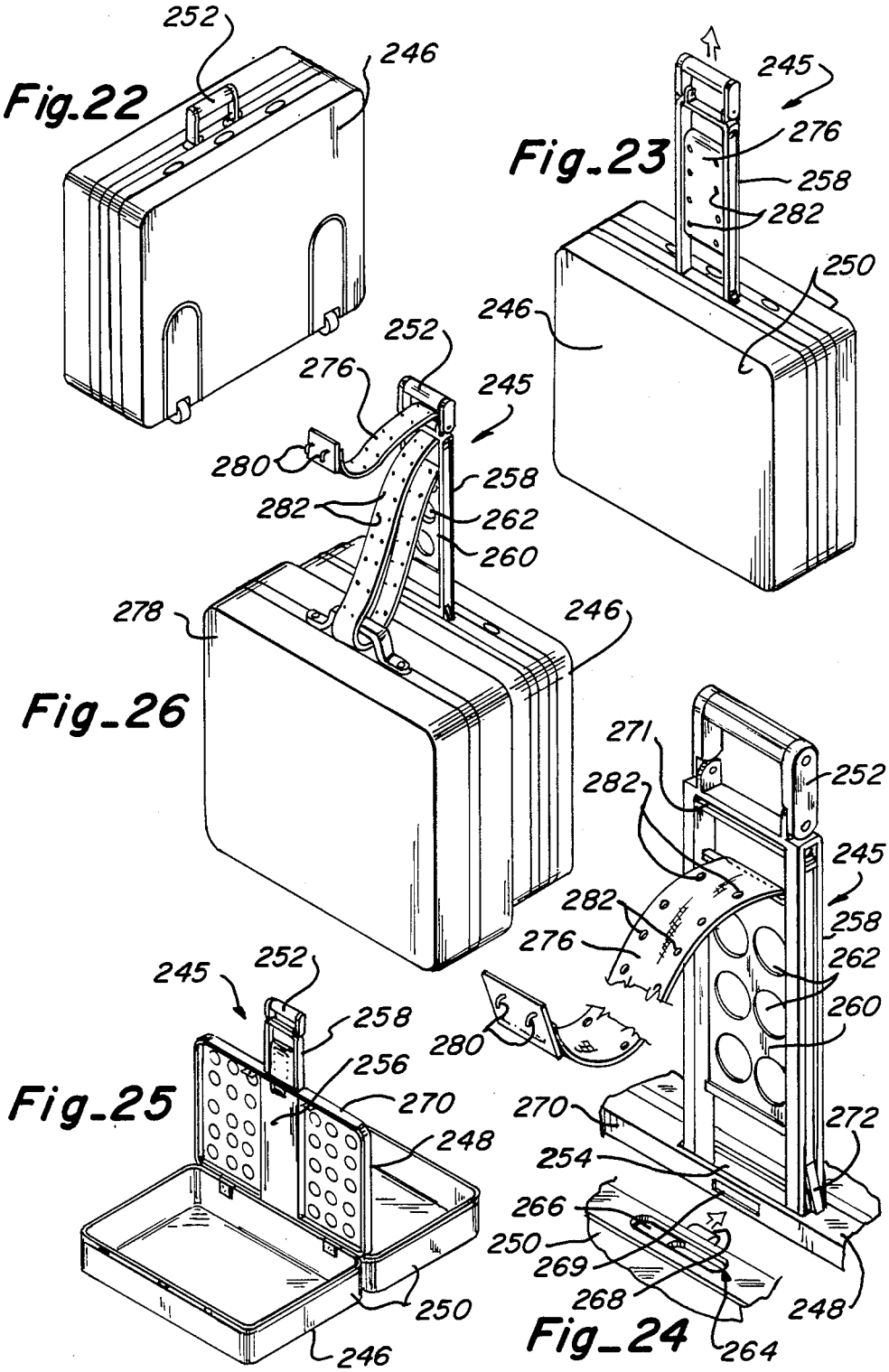
FIG. 22 is a perspective view of a third embodiment of the present invention with its handle unit in a retracted position.
FIG. 23 is a perspective view of the article of luggage shown in FIG. 22 with the handle unit in an extended position.
FIG. 24 is an enlarged fragmentary perspective view showing the handle unit shown in FIG. 22 in its extended position and with the strap means being extended therefrom.
FIG. 25 is a perspective view of the article of luggage as shown in FIG. 22 with the luggage opened to illustrate the positioning of the handle unit within the luggage.
FIG. 26 is a perspective view of the article of luggage as shown in FIG. 23 with a piece of auxiliary luggage piggybacked thereon.
Figure 27:
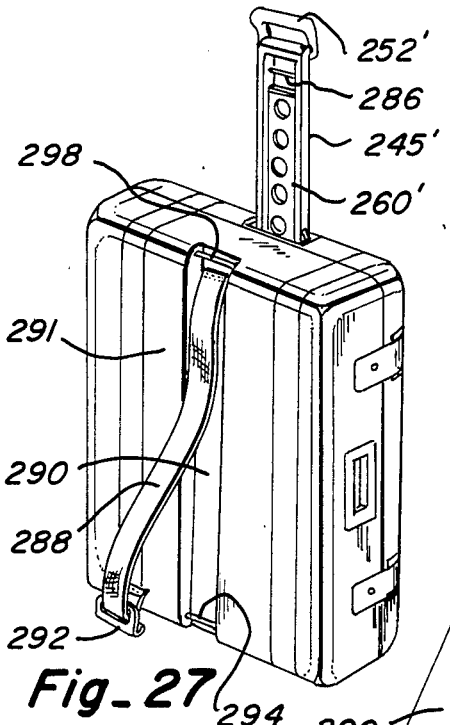
FIG. 27 is a perspective view of a fourth embodiment of the present invention.

The suitcase 246 has a pocket 254 defined by a metal box 256 provided on the divider 248 in which a rectangular frame or slide element 258 having the grip 252 pivotally attached to the upper edge thereof is slideably fit. The slide element has a mounting plate 260 secured thereto with the plate having a plurality of holes 262 therein to minimize the weight of the slide element. The slide element is slideable between a rectracted position shown in FIG. 22 and an extended position shown in FIGS. 23, 24 and 26 with the slide element being releasably secured in its retracted position by a slide catch 264 mounted on one component part 250 of the suitcase. The slide catch has a finger operable slide 266 which functions to move a lock bar 268 through an opening 269 in the top frame member 270 of the divider 248 and into and out of a groove 271 formed in the slide element 258 immediately beneath the grip 252. When the lock bar protrudes into the groove 271 the slide element is prevented from being extended and, therefore is locked in its retracted position. Removal of the lock bar from the groove, however, allows the slide element to be slid outwardly to its extended position. The slide element 258 is retained in the extended position by a flexible tab 272 formed in one side of the slide element which snaps over the top frame member 274 of the divider 248 as shown in FIG. 24. Depression of the flexible tab of course allows the slide element to be slid back into the pocket 254.

The strap 276 utilized in this embodiment of the invention to secure an auxiliary piece of luggage 278 to the main piece of luggage 246 in a piggyback fashion is merely an elongated strap which is anchored at one end to the top edge of the mounting plate 260 and can be wrapped around the mounting plate when the strap is not being used. However, to use the strap, it is merely unwrapped from the mounting plate and extended around the handle or some other portion of the auxiliary suitcase 278 and reconnected to itself to fix the extended length of the strap. For this purpose, a pair of hooks 280 are provided on the undersurface of the strap at its free end and a plurality of pairs of holes 282 are aligned with the hooks at spaced locations along the length of the strap. In this manner, after the strap has been passed around the handle or some other portion of the auxiliary piece of luggage, it can be returned and passed through the grip 252 on the slide element 258 before inserting the hooks 280 into an appropriate pair of holes 282 on the strap to releasably fix the extended length of the strap.

A fourth embodiment of the present invention is illustrated in FIGS. 27 through 30 with like parts having been given like reference numerals with a prime suffix. In this embodiment, the handle unit 245' is substantially similar to the handle unit 245 of the third embodiment except that the strap for supporting auxiliary luggage is not attached to the handle unit and the handle unit includes a transverse cylindrical anchor rod 286 in the space between the mounting plate 260' and the grip 252' on the handle unit.

Figure 29:
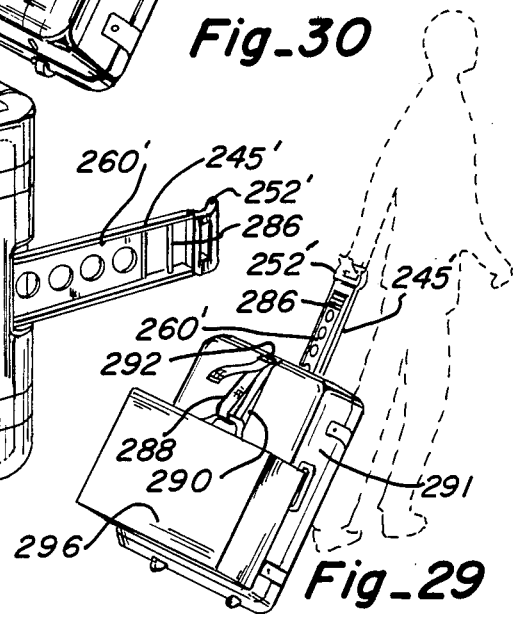
FIG. 29 is a perspective view of the article of luggage of FIG. 27 being transported by an individual shown in dashed lines and with an auxiliary article of luggage attached thereto.

This embodiment of the present invention is again described in connection with a hard cased suitcase having wheels mounted thereon as with the other embodiments. The flexible strap 288 in this embodiment, however, is disposed in a groove 290 established in one face 291 of the suitcase with the groove extending parallel to the handle unit 245'. Referring to the end of the suitcase through which the handle unit is extended as the upper end of the suitcase, the strap 288 is fixed at its upper end to a transverse rod (not seen) disposed within the groove 290 near the upper end of the suitcase so that the strap can lie completely within the groove. The strap has a hook member 292 on its free end which is releasably connectable to another anchor rod 294 disposed at the opposite end of the groove near the bottom of the suitcase. By adjusting the length of the strap after the hook member 292 is disposed on the anchor bar 294, the strap can be tightly drawn between its fixed end at the top of the suitcase and its releasably hooked end at the bottom of the suitcase so as to remain in place in the protected groove in contiguous relationship with the face 291 when not in use. However, when use of the strap is desired to piggyback an auxiliary piece of luggage 296 as illustrated in FIG. 29, the hook member 292 can be released from the anchor rod 294 and passed through the handle of the auxiliary piece of luggage, or around the auxiliary piece of luggage as desired, before releasably hooking the hook to a third anchor rod 298 disposed at the top of the suitcase within the groove 290 and immediately adjacent to the fixed end of the strap.

Figure 30:
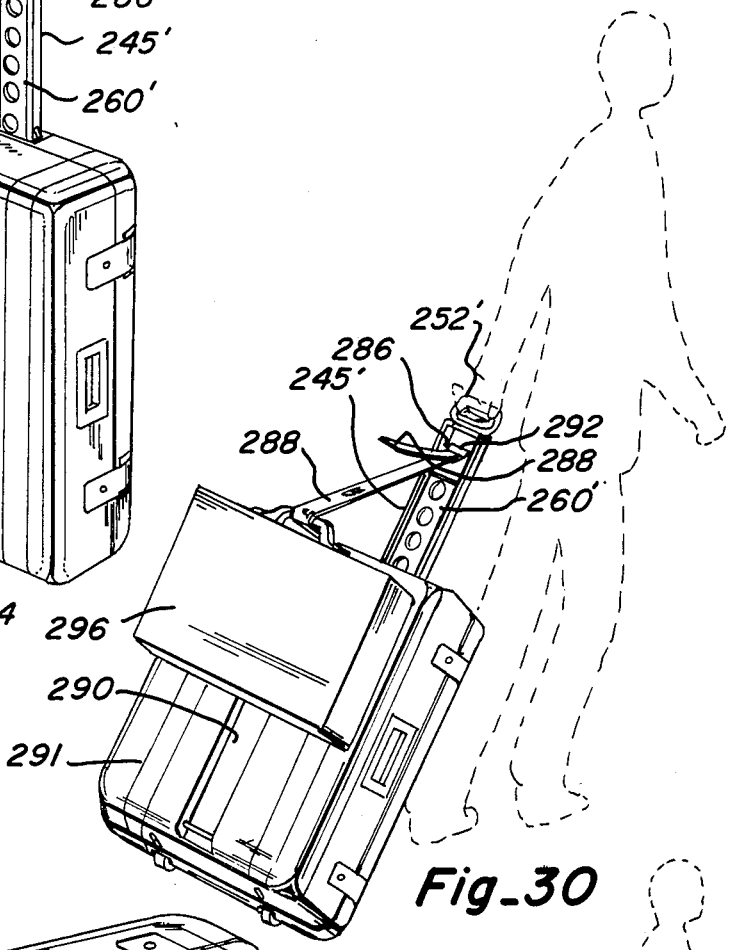
FIG. 30 is a perspective view similar to FIG. 29 with the auxiliary article of luggage attached in a different manner.
Figure 28:
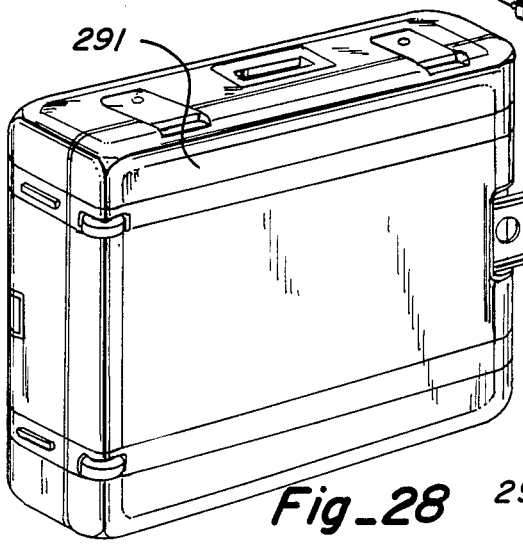
FIG. 28 is another perspective view of the embodiment of FIG. 27 showing the opposite side of the article of luggage.

In an alternative arrangement illustrated in FIG. 30, which is particularly useful with larger pieces of auxiliary luggage, the strap 288 after being passed around the auxiliary piece of luggage or through the handle thereof can be hooked to the anchor rod 286 on the handle unit so that the auxiliary piece of luggage is supported in a more elevated relationship to the main piece of luggage. As will be appreciated with this embodiment of the invention, when the strap is not in use, as mentioned previously, it is confined within the groove 290 established in the face of the main piece of luggage so that it cannot easily be snagged or otherwise damaged by contact with other articles and is disposed in an aesthetically pleasing manner so as not to distract from the appearance of the suitcase.

When it is desired to remove the auxiliary piece of luggage from the main piece of luggage, the strap is merely released from itself, removed from the auxiliary piece of luggage, wrapped around the mounting plate on the handle unit, and again secured to itself.

We claim:

1. In a piece of luggage having a main body defining an interior space in which articles of clothing and the like can be maintained, said main body including roller means upon which the main body can be rolled along a supporting surface, and a handle unit for gripping the luggage and moving it along the supporting surface, the improvement comprising elongated strap means forming a part of said handle unit, said strap means being movable from a stored position on said handle unit to an extended position wherein it is adapted to releasably secure an auxiliary piece of luggage to said first mentioned piece of luggage.

2. In the piece of luggage of claim 1 wherein said handle unit includes an elongated slide element having a grip thereon and the slide element is adapted to be extended away from said main body.

3. In the piece of luggage of claim 2 wherein said strap means is disposed on said slide element.

4. In the piece of luggage of claim 3 wherein said slide element includes mounting means around which said strap means can be wrapped when the strap means is in its stored position.

5. In the piece of luggage of claim 4 wherein said mounting means around which said strap can be wrapped includes resilient means to bias the strap into its stored position.

6. In the piece of luggage of claim 5 wherein said mounting means includes a plurality of parallel support bars around which said strap is wrapped, at least some of said support bars being movable toward and away from each other to allow the strap to be moved between its extended and stored positions.

7. In the piece of luggage of claim 6 wherein said resilient means is operatively connected to at least some of said support bars to bias at least some of the support bars away from each other.

8. In the piece of luggage of claim 3 wherein said strap has one end thereof anchored to the handle unit and a free end adapted to extend around said auxiliary luggage, said free end including a hook thereon, and an anchor on said handle unit to which said hook can be releasably attached.

9. In the piece of luggage of claim 7 wherein said strap has one end thereof anchored to the handle unit and a free end adapted to extend around said auxiliary luggage, said free end including a hook thereon, and an anchor on said handle unit to which said hook can be releasably attached.

10. In the piece of luggage of claim 4 wherein said slide element is a box-like element in which the strap means is enclosed while in its stored position.

11. In the piece of luggage of claim 7 further including lock means on said handle unit, said lock means being operatively engageable with said strap means to selectively retain the strap means in its extended position.

12. In the piece of luggage of claim 3 wherein said strap means has one end anchored to said slide element and a free end adapted to be extended around at least a portion of said auxiliary piece of luggage, said free end having fastening means thereon adapted to be secured to another portion of said strap means.

13. In the piece of luggage of claim 12 wherein said strap means has a plurality of holes along its length and wherein said fastening means consists of at least one hook adapted to cooperate with at least one of said holes to permit the free end to be releasably secured to another portion of said strap means.

14. In the piece of luggage of claim 13 wherein said slide element includes mounting means around which said strap means can be wrapped when the strap means is in its stored position.

15. In the piece of luggage of claim 4 wherein said mounting means around which said strap can be wrapped includes a plurality of parallel support bars with at least one of said support bars being mounted on a slide block which is movable longitudinally of the slide element as the strap means is moved between its stored and extended positions, said slide element including guide means for guiding movement of the slide block longitudinally of the slide element and resilient means for yieldingly resisting movement of the slide block in a first direction as the strap means is moved from its stored to its extended positions.

16. In the piece of luggage of claim 15 wherein said guide means consists of channels extending longitudinally along opposite sides of said slide element, and wherein said resilient means is connected to one side of said slide block adajacent to one of said channels and is adapted to wedge the slide block between said channels to prevent movement of the slide block in a second direction which is opposite to said first direction when the strap means is not being moved to its extended position.

17. In the piece of luggage of claim 16 further including return means mounted on said slide element and operatively associated with said slide block to dislodge the slide block from its wedged condition to permit the slide block to be moved in said second direction and the strap means to be moved from its extended to its stored position.

18. In the piece of luggage of claim 17 wherein said return means is further operatively associated with said slide block whereby movement of the slide block in said first direction will cause said return means to be moved in said first direction and movement of the return means in said second direction will cause the slide block to move in the second direction thus effecting movement of the strap means from its extended position to its stored position.

19. A piece of luggage having a main body defining an interior space in which articles of clothing and the like can be maintained, said main body including roller means upon which the main body can be rolled along a supporting surface and having elongated strap means having one end permanently attached thereto and a free end adapted to be extended around at least a portion of an auxiliary piece of luggage to releasably secure the auxiliary piece of luggage to the main body, and a handle unit extensibly mounted on said main body for movement between a stored position in compact relationship with said main body and an extended position from which the main body can be easily rolled along said supporting surface, said handle unit including anchor means thereon for releasably securing the free end of said strap means.

20. The piece of luggage of claim 19 further including retraction means on said handle unit to facilitate moving said strap means from its extended position to its stored position.

21. The piece of luggage of claim 19 wherein said handle unit includes a slide element having a box-like frame and wherein said strap means is enclosed within said box-like frame when the strap means is in its stored position.

22. In a piece of luggage having a main body including a plurality of wall members which in combination define an interior space in which articles of clothing and the like can be maintained, said main body including roller means upon which the main body can be rolled along a supporting surface, the improvement comprising an extensible handle unit having an elongated strap means as a part thereof mounted on said main body in contiguous relationship with one of said wall members, said handle unit including a slide element movable from a stored position adjacent to and parallel with said one wall member to an extended position forming an extension away from said one wall member, and wherein said strap means is movable from a stored position to an extended position whereby in the extended position the strap can be releasably connected to a piece of auxiliary luggage to releasably connect the auxiliary luggage to said main body.

23. In a piece of luggage having a main body defining an enclosure in which articles of clothing and the like can be maintained, said main body having a pair of component parts adapted to be moved into confronting relationship along a plane of confrontation, the improvement comprising a handle unit mounted on said main body along said plane of confrontation, said handle unit including a slide element adapted to be extended away from said main body and an elongated strap means adapted to be moved from a stored position to an extended position so as to be releasably attached to a piece of auxiliary luggage.

24. In a piece of luggage having a main body defining an interior space in which articles of clothing and the like can be maintained, said main body including roller means upon which the main body can be rolled along a supporting surface, the improvement comprising a handle unit mounted on said main body and including a slide element which is movable from a retracted position to an extended position, said slide element including an elongated strap having one end anchored thereto and a free end adapted to be passed around at least a portion of a piece of auxiliary luggage to releasably connect the auxiliary luggage to the main body, said elongated strap being anchored to the slide element such that it is concealed within the confines of the main body when the slide elements is retracted and becomes automatically exposed for use when the slide element is moved to its extended position.

25. In the piece of luggage of claim 24 wherein said handle unit can be used to carry the piece of luggage when the slide element is in the retracted position and can be used to roll the piece of luggage along the supporting surface when the slide element is in the extended position.

26. In the piece of luggage of claim 1 wherein said strap means has one end operably secured to said handle unit and a free end adapted to be passed around at least a portion of said auxiliary piece of luggage.

27. In the piece of luggage of claim 26 wherein said strap has fastener means along its length to which it can be connected to itself to vary the length of strap utilized for securing the auxiliary piece of luggage.

28. In the piece of luggage of claim 27 wherein said fastener means includes a plurality of holes along the length of the strap and at least one hook near the free end of the strap so that the hook can be releasably received in one of the holes.

29. In the piece of luggage of claim 28 wherein said handle unit has means thereon through which the free end of the strap can be passed to operably secure the strap to the handle unit at two locations.

30. In the piece of luggage of claim 29 wherein said one end of the strap is permanently attached to said handle unit.

* * * * *